US006224410B1

(12) United States Patent
Chen

(10) Patent No.: US 6,224,410 B1
(45) Date of Patent: May 1, 2001

(54) STRUCTURE OF A COPPER HEAD SOCKET FOR A LIGHT BULB

(76) Inventor: Chuan-Ying Chen, P.O. Box 82-144, Taipei (TW)

( * ) Notice: Subject to any disclaimer, the term of this patent is extended or adjusted under 35 U.S.C. 154(b) by 0 days.

(21) Appl. No.: 09/542,850

(22) Filed: Apr. 4, 2000

(51) Int. Cl.[7] ..... H01R 4/38
(52) U.S. Cl. ..... 439/257; 439/414
(58) Field of Search ..... 439/253, 257, 439/414, 416, 419; 362/226; 313/318.03, 318.04

(56) References Cited

U.S. PATENT DOCUMENTS 1,770,377 * 7/1930 Wolfe ..... 439/257
4,548,449 * 10/1985 Corsetti ..... 439/641
6,033,248 * 3/2000 Lyons ..... 439/257

* cited by examiner

*Primary Examiner*—Khiem Nguyen
*Assistant Examiner*—Son V. Nguyen
(74) *Attorney, Agent, or Firm*—A & J

(57) ABSTRACT

The present invention relates to a copper head socket for light bulb comprising (a) a base seat having an open end and another end having a cylindrical shape center shaft hole; (b) a connection seat which is a hollow cylinder; (c) a threaded base seat including two corresponding member hingedly mounted together at one end to grip the copper cap of the light bulb and the other end of the threaded seat being a center aperture; (d) a press-stopping; and (e) a hole cap. In accordance with the present invention a copper capped electrical light bulb can repeatedly urge the socket so that the loading and/or unloading of a light bulb can be achieved easily and conveniently.

1 Claim, 6 Drawing Sheets

STRUCTURE OF A COPPER HEAD SOCKET FOR A LIGHT BULB

BACKGROUND OF THE INVENTION a) Technical Field of the Invention

The present invention relates to a structure of a copper head socket for a light bulb, and in particular, a socket which allows the repeatedly urging of the socket by an electrical bulb to load and/or unload the bulb into the socket or remove the bulb from the socket b) Description of the Prior Art Conventional copper head socket for light bulb essentially comprises a base seat which is used to mount onto a wall of lighting fixtures and a threaded base seat which can form into a loop with a power source wire and is used to hold the copper head of the light bulb. This type of socket has the following drawbacks: when unloading the bulb or unscrew the copper head of the light bulb, the bulb is rotated counter-clockwise but the hands have to hold the bulb as we have no idea whether the bulb has been fully dislocated from the threaded base seat. The hands may not be removed from the bulb as the bulb may be fallen if the copper head of the bulb has fully disengaged with the socket. Another drawback is that the applied external force to unscrew the bulb may break the glass of the electrical bulb as a stronger force may have to apply to unscrew the bulb for some bulbs may be adhered strongly to the socket. For instance, the bulb which has been loaded to the socket for numbers of years. Thus it is imperatively for the inventor to solve the above drawbacks by providing a structure of a copper head socket for light bulb which can be easily and conveniently loaded into and/or unloaded from the socket.

SUMMARY OF THE INVENTION

Accordingly, an object of the present invention is to provide to a copper head socket for light bulb comprising (a) a base seat having an open end and another end having a cylindrical shape center shaft hole; (b) a connection seat which is a hollow cylinder; (c) a threaded base seat including two corresponding member hingedly mounted together at one end to grip the copper cap of the light bulb and the other end of the threaded seat being a center aperture; (d) a press-stopping; and (e) a hole cap. In accordance with the present invention a copper capped electrical light bulb can repeatedly urge the socket so that the loading and/or unloading of a light bulb can be achieved easily and conveniently.

A further object of the present invention is to provide A copper head socket for light bulb comprising (a) a base seat, which can be mounted onto a wall or other lighting fixtures, having an open end and another end having a cylindrical shape center shaft hole, the inner bottom edge of the hole being provided with a blocking edge and the wall surface of the hole being formed into a plurality of deep and shallow slots by means of a plurality of protruded rails; (b) a connection seat which is a hollow cylinder having one end connected to the open end of the base seat and the inner bottom end of another end being provided with a blocking edge and a pair of protruded arch-shaped block; (c) a threaded base seat including two corresponding member hingedly mounted together at one end to grip the copper cap of the light bulb when the light bulb is inserted into the threaded base seat, the other end of the threaded seat being a center aperture with a threaded seat body; (d) a press-stopping mechanism having a press rod, a rotating peg inserted into the top end of the press rod, and a spring mounted at the top section of the rotating peg, wherein the press rod is a hollow shaft body and the top end of the shaft body has eight rows of positioning teeth which can slide within the shaft hole of the rotating peg, the middle section of the shaft body is provided with four rows of stopping teeth and the bottom section of the shaft body is inserted at the top end of the press rod, and the spring is restricted in between the hole edge of the top end of the rotating peg and the shaft hole of the base seat such that the rotating peg and the press rod maintain an elastic pressure; and (e) a hole cap which covers the shaft hole of the base seat and providing passage for wires of a power source.

Yet another object of the present invention is to provide a copper head socket for light bulb, wherein the positive wire end of the power source passes the hole cap, the rotating peg, the press rod in sequence and is welded at the outlet at the bottom end of the press rod; and the negative wire end passes through the base seat and is welded at the threaded base seat to form a loop.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
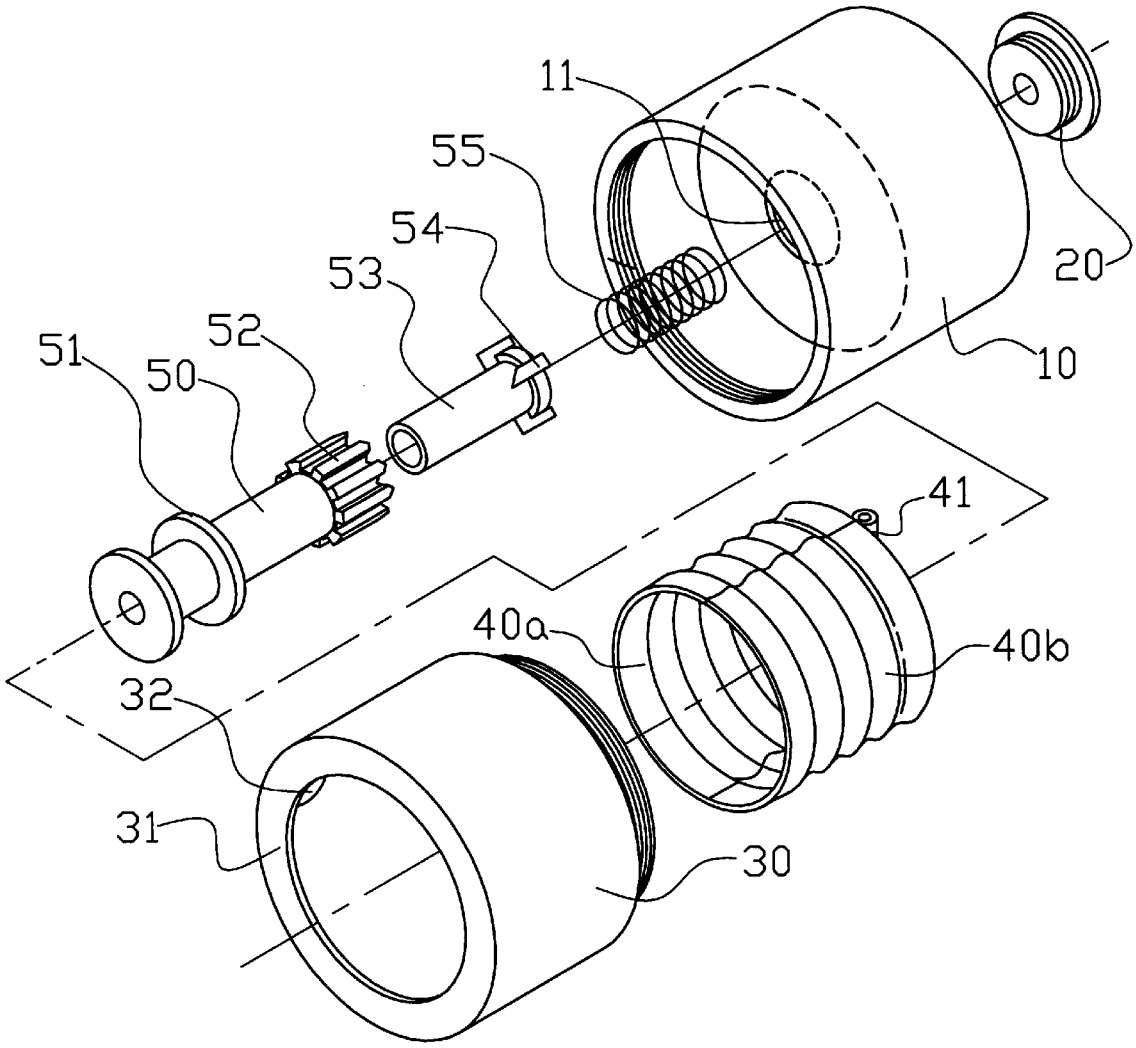
FIG. 1 is a perspective exploded view of a bulb seat structure of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
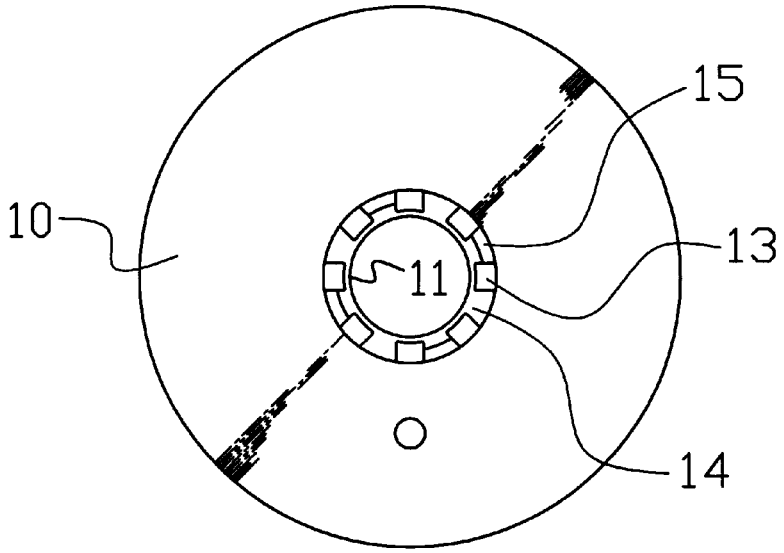
FIG. 2 is a top view of the bottom seat structure of the bulb seat of the present invention.
Figure 3:
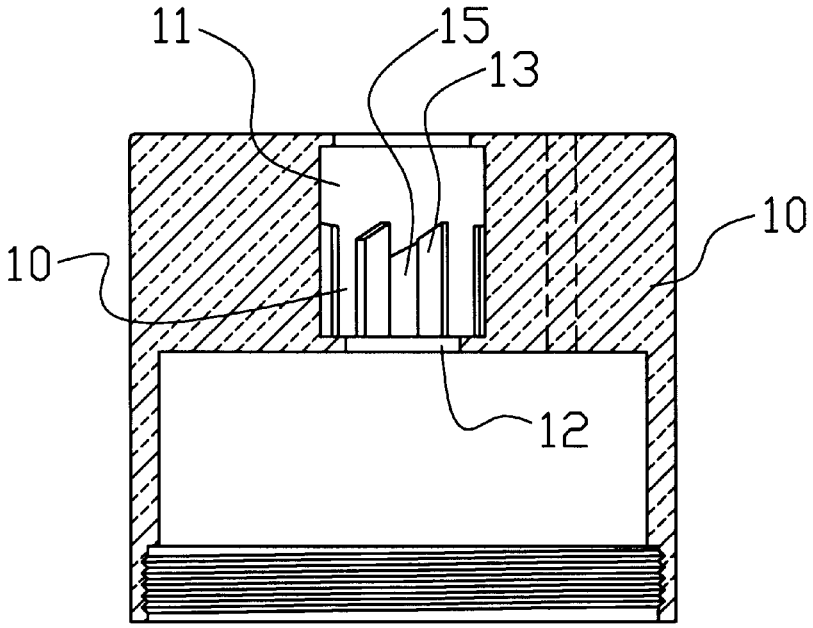
FIG. 3 is an elevational view of the bottom seat structure of the bulb seat of the present invention.
Figure 4:
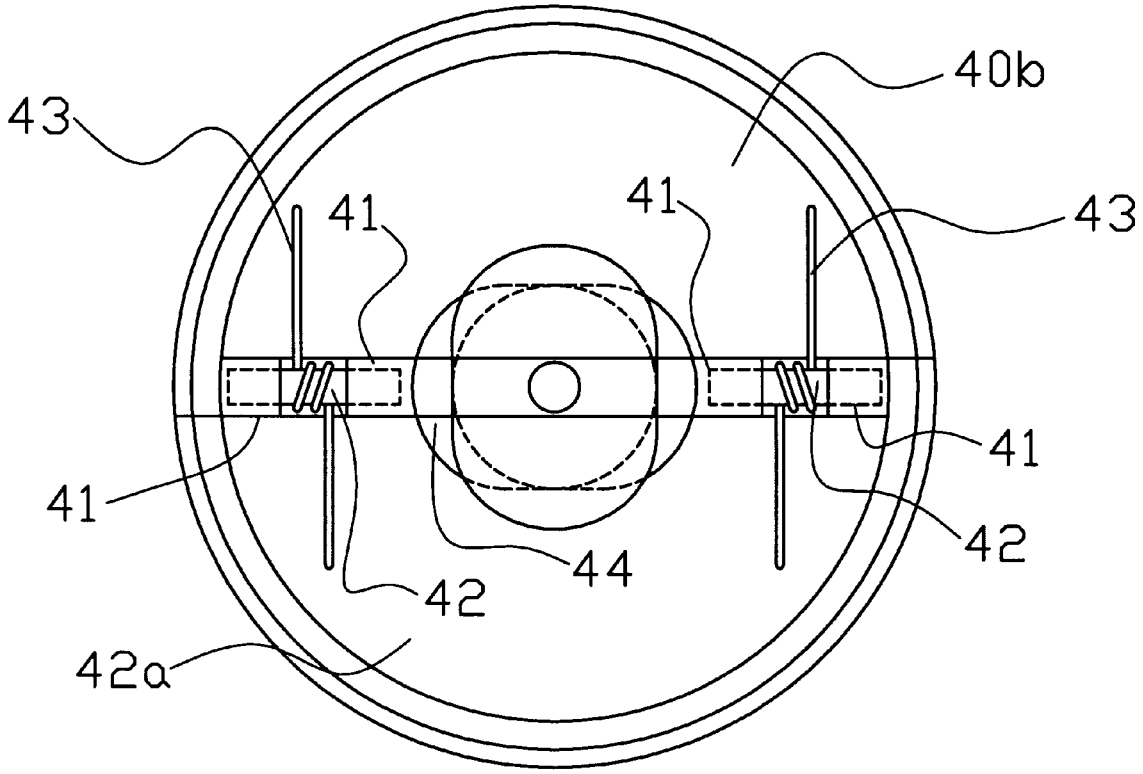
FIG. 4 is a bottom view of the screw threads base seat of the bulb seat of the present invention.
Figure 5:
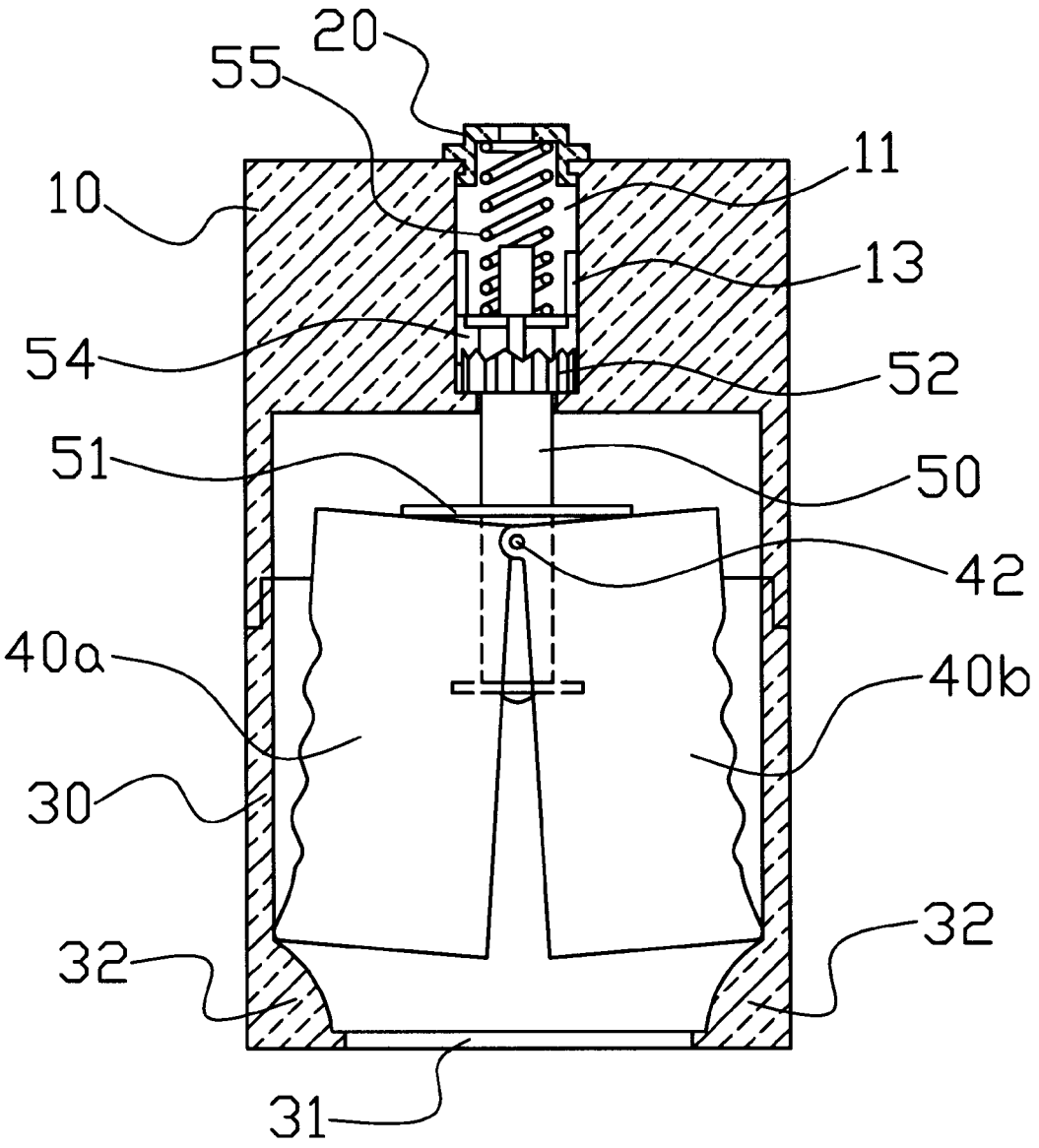
FIG. 5 is a sectional view of the bulb seat of the present invention.
Figure 7:
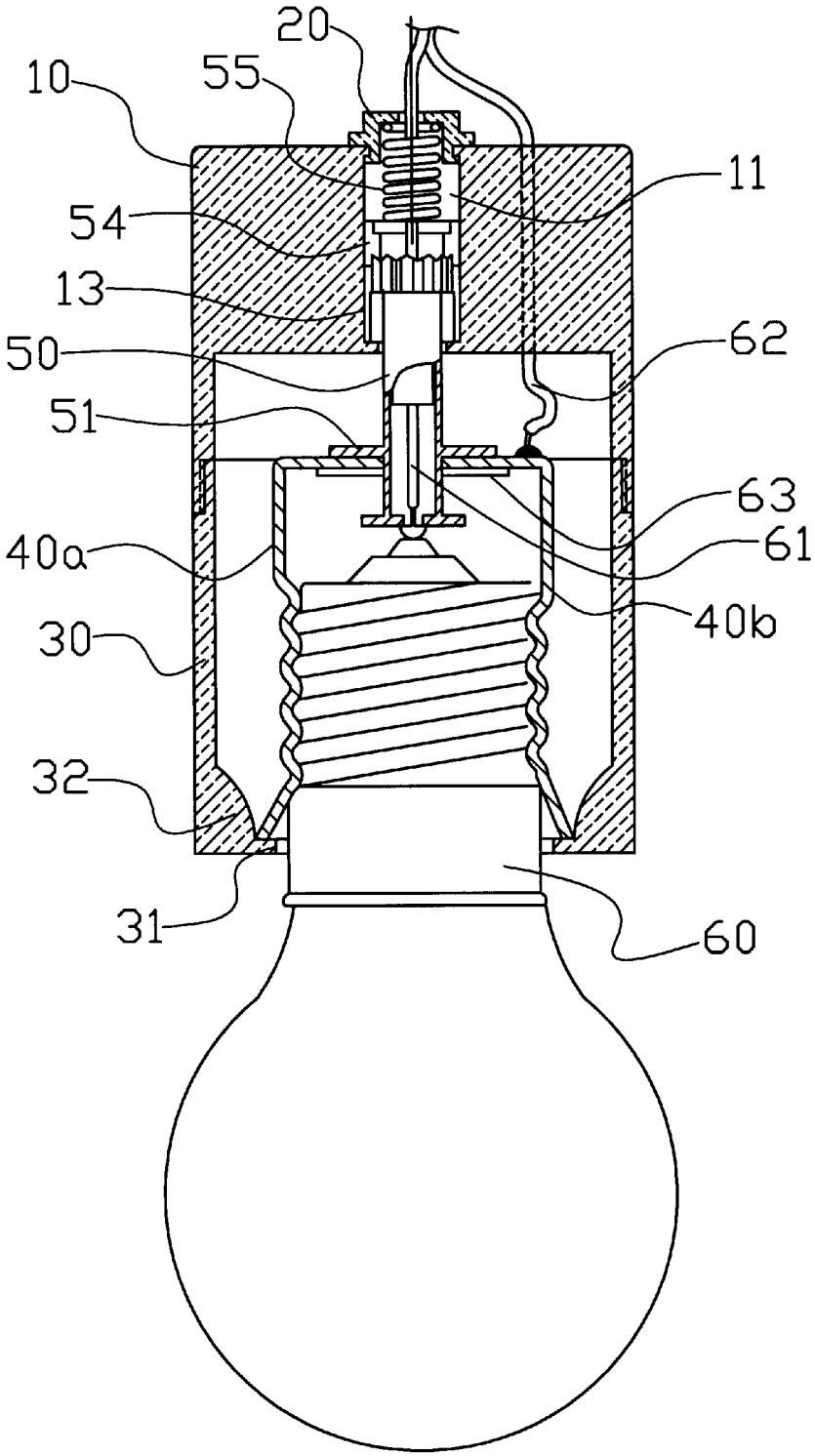
FIG. 7 schematically shows the mounting of an electrical bulb on the bulb seat of the present invention.

Referring to FIG. 1, there is shown an electrical socket for a light bulb comprising a base seat 10 for mounting onto a wall surface, or lighting fixtures, a connection seat 30 connected to one end of the base seat, a threaded base seat including two identical corresponding components 40*a,* 40*b* pivotally hinged at one end of the components and located within the connection seat 30, and a press-stopping mechanism including a press rod 50, a rotating peg 54, a spring 55 mounted in between the threaded base seat 41 and the base seat 30. Referring to FIGS. 1, 2 and 3, the base seat 10 has one open end provided with screw threads, and the other end has a shaft hole 11 of cylindrical shape. The inner wall of the shaft hole 11 is provided with a plurality of rails 13 of different length, which form into a plurality of deep slots 14 and shallow slots 15. The inner bottom edge of the shaft hole 11 is provided with a blocking edge 12. Referring to FIGS. 1 and 5, the inner bottom edge of the other end of the connection seat 30 is provided with a blocking edge 31 and a pair of protruded arch-shaped block 32. Referring again to FIGS. 1 and 4, the threaded base seat 40 comprises two identical corresponding members 40*a,* 40*b* formed pivotally at one end for the mounting of a light bulb copper cap 60. The other end of the thread base seat 40 has an oval shape center aperture 44. The top edge of the connection end of two members 40*a,* 40*b* is provided with a peg seat 41. A peg 42 is mounted with a spring 43 to urge the bottom end of the two corresponding members 40*a,* 40*b* to be extended. Referring to FIGS. 1, 5 and 7, wherein the press rod 50 is a hollow shaft having a shaft end being formed into eight rows of positioning teeth 52 and are slidably mounted at the bottom of the base seat 10 within the shaft hole 1.

The shaft body is formed into an engaging block 51 pivotally mounted at the center aperture 44 of the threaded base seat. The rotating peg 53 is a hollow body and there are four rows of stopping teeth 54 at the middle section of the hollow peg body. The lower section of the hollow peg body is inserted at the top end of the press rod 50. The spring 55 is mounted onto the upper section of the rotating peg 53, and maintains an elastic pressure with the press rod 50. In the above socket for light bulb, the positive wire 61 end of a power source passes through, in sequence, the hole cap 20, the rotating peg 53, the press rod 50 and is welded at the outlet of the bottom end of the press rod 50. The negative wire 62 end passes through the base seat 10 and is welded at the threaded base seat forming into a loop.

Figure 6:
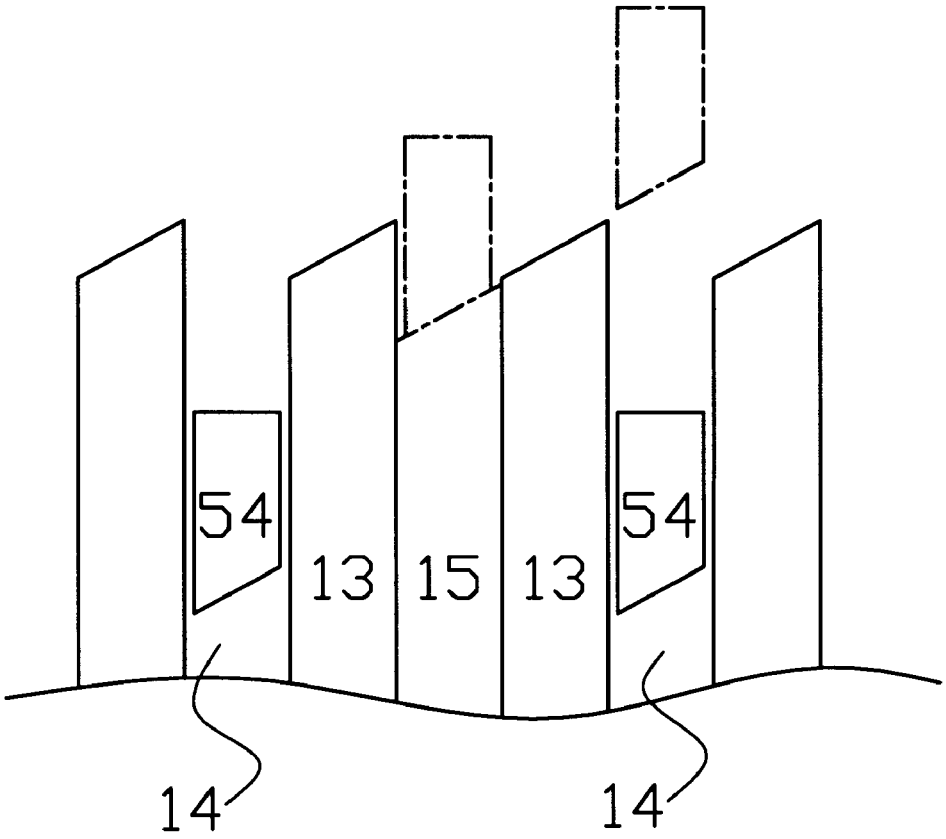
FIG. 6 shows schematically the stopping teeth of the engaging mechanism of the present invention.

In accordance with the present invention, the working of the components of the socket is shown as follows: The press rod 50 slidably moves as a result of the compression of the spring 55 when it moves to the highest (as shown in FIG. 6), the stopping teeth 54 of the rotating peg 53 will slide along the top edge of the rails 13 to the next slot. When the socket for the light bulb has not been mounted with the electrical bulb, the stopping teeth 54 moves to the position of the shallow slot 15 so as to cause the press rod 50 to be in a relatively high position. Thus, the two corresponding members 40*a,* 40*b* are extended to open by the spring 43, and the action thereof is increased, until the bottom end of the two corresponding member 40*a,* 40*b* urges at the top edge of the arch-shaped block 32. The extended angle of the corresponding members 40*a,* 40*b* of the threaded base seat allows direct mounting of the light bulb thereto. When the stopping teeth 54 of the rotating peg 53 enters into the deep slot 14, the rotating peg 53 and the press rod 50 are altogether urged by the spring 55 and are lowered until the positioning teeth 52 of the press rod 50 urge at the blocking edge 12 of the shaft hole. The height of the press rod 50 exactly urges the bottom end of the two corresponding members 40*a,* 40*b* of the threaded base seat to the blocking edge 31 of the connection seat 30 so that a connection is integrally formed or restored by means of the engaging block 51. By employing the above structure, as shown in FIG. 7, when a light bulb is to be mounted, the copper cap 60 end is directly inserted into the open end of the connection seat 30 until the press rod 50 is pushed upward to the bottom thereof and then release the press rod 50. The two corresponding members 40*a,* 40*b* appropriately approach each other to enclose the copper cap as one unit. When unload the light bulb, the light bulb is held by hand and then is pushed forwards the socket once, and the bulb can be unloaded.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A copper head socket for a light bulb comprising:

(a) a base seat having an open end, another end of the base seat having a cylindrical shape center shaft hole, an inner bottom edge of the cylindrical shape center shaft hole being provided with a blocking edge, a wall surface of the cylindrical shape center shaft hole being formed into a plurality of deep and shallow slots by means of a plurality of protruded rails;

(b) a connection seat which is a hollow cylinder having one end connected to the open end of the base seat and an inner bottom end of another end of the hollow cylinder being provided with an edge and a pair of protruded arch-shaped blocks;

(c) a threaded base seat including two corresponding members having one end hingedly mounted together to grip a copper cap of the light bulb when the light bulb is inserted into the threaded base seat, another end of the threaded seat having a center aperture;

(d) a press-stopping mechanism having a press rod, a rotating peg inserted into a top end of the press rod, and a spring mounted at a top section of the rotating peg, wherein the press rod is a hollow shaft body and a top end of the shaft body has eight positioning teeth which can slide within the shaft hole of the rotating peg, a middle section of the shaft body is provided with four stopping teeth and a bottom section of the shaft body is inserted at the top end of the press rod, and the spring is restricted in between a hole edge of the top end of the rotating peg and the shaft hole of the base seat such that the rotating peg and the press rod maintain an elastic pressure;

(e) a hole cap which covers the shaft hole of the base seat and providing passage for wires of a power source;

(f) a positive wire end of a power source passes the hole cap, the rotating peg, the press rod in sequence and is welded at an outlet at a bottom end of the press rod, and a negative wire end passes through the base seat and is welded at the threaded base seat to form a loop; and thereby a copper capped electrical light bulb can urge the socket so that loading and/or unloading of the light bulb can be achieved easily and conveniently.

* * * * *